US005431279A

United States Patent [19]

Robinette et al.

[11] Patent Number: 5,431,279

[45] Date of Patent: Jul. 11, 1995

[54] WALLBOARD BUNDLING TAPE AND METHOD

[75] Inventors: Joseph R. Robinette, Bristol, Tenn.; Raymond G. Syracuse, Charlotte, N.C.

[73] Assignees: National Gypsum Company, Dallas, Tex.; The Robinette Company, Bristol, Tenn.

[21] Appl. No.: 273,462

[22] Filed: Jul. 11, 1994

Related U.S. Application Data

[60] Division of Ser. No. 8,319, Jan. 25, 1993, Pat. No. 5,358,757, which is a continuation-in-part of Ser. No. 833,002, Feb. 10, 1992, abandoned, which is a continuation-in-part of Ser. No. 460,587, Jan. 3, 1990, Pat. No. 5,087,310.

[51] Int. Cl.[6] ..... B65D 85/46

[52] U.S. Cl. ..... 206/321; 206/451; 229/120.011; 229/926

[58] Field of Search ..... 206/192, 321, 526, 451; 229/120.011, 926

[56] References Cited

U.S. PATENT DOCUMENTS

| | | | |
|---|---|---|---|
| 1,827,636 | 10/1931 | Ames | 428/194 |
| 3,241,276 | 3/1966 | Vance et al. | 206/321 |
| 3,854,581 | 12/1974 | Jones, Jr. | 206/526 |
| 4,936,464 | 6/1990 | Kim | 206/617 |
| 5,087,310 | 2/1992 | Robinette | 206/415 |

*Primary Examiner*—David T. Fidei
*Attorney, Agent, or Firm*—Fulwider Patton Lee & Utecht

[57] ABSTRACT

A bundling tape has two rows of perforations extending from one end of the tape to the other; the perforations are arranged inward of and substantially parallel to the edges. A first band is formed between one edge and a first row of perforations, and a second band is formed between the other edge and the second row of perforations; between the two rows of perforations is a center band tear strip. The bands have co-planar upper and lower surfaces. A laminated bundling tape embodiment also has an additional zipper tape attached to the lower surface of the center band, and apparatus and methods are described for making this laminated tape. Bundles of material, such as wallboard, are fastened together by adhering the bottom surface of the first band to the uppermost sheet of material, and by adhering the bottom portion of the second band to the lowermost sheet.

7 Claims, 6 Drawing Sheets

WALLBOARD BUNDLING TAPE AND METHOD

This is a division of application Ser. No. 08/008,319, filed Jan. 25, 1993, now U.S. Pat. No. 5,358,757 is a continuation-in-part of U.S. patent application Ser. No. 07/833,002, filed Feb. 10, 1992, now abandoned, which is a continuation-in-part of U.S. patent application Ser. No. 07/460,587, filed Jan. 3, 1990, which issued on Feb. 11, 1992 as U.S. Pat. No. 5,087,310.

FIELD OF THE INVENTION

This invention is directed to forming bundles of material and in particular to forming bundles comprising two sheets of wallboard, and is further directed to a bundling tape and apparatus and method for making same.

BACKGROUND OF THE INVENTION

Wallboard is frequently used as a wall material in home and commercial construction. Wallboard, often referred to as gypsum wallboard, is normally shipped in bundles of two rectangular sheets which are held together by a printed paper tape called bundling tape applied along the edges of the end sheets. The bundling tape is applied to the edges of the two sheets of wallboard at the gypsum manufacturing plant; the tape can either have pre-applied adhesive on the back, or the adhesive can be applied to the back of the bundling tape immediately at the point of application to the wallboard.

Typically, wallboard has a smooth surface on one side and a coarse or tougher surface on the other side. The smooth surface will ultimately face outward into the room where the wallboard is installed. The coarse backing surface is generally tougher, and there is little concern if the coarse back sheet is scratched or nicked in transport. For this reason the bundles are usually formed with the smooth surfaces facing one another and with the rough or coarse surfaces facing outward.

With reference to FIG. 1, a prior art wallboard bundle 115 is illustrated. An upper sheet 117 has its downwardly facing smooth surface facing, and resting upon, the smooth upwardly facing surface (not shown) of lower sheet 119; rough surface 116 on upper sheet 117 is facing upward while the rough surface (not shown) of lower sheet 119 faces downward. Sheets 117 and 119 are generally rectangular in shape, and have side edges 112 and end edges 114. To economize on space in shipping, and to facilitate the formation of bundles, sheets 117 and 119 are arranged so that the side edges 112 and the end edges 114 are co-planar with the edges of the other sheet in the bundle, A small gap 144 may be visible between the two sheets.

Sheets 117 and 119 are fastened together through the use of prior art bundling tape 110 which is applied to end edges 114 and which overlaps onto rough surfaces 116. A zipper tape 111 is placed over the gap 144 when the bundling tape 110 is applied. The bundling tape 110 adheres to the zipper tape as well as to the end edges 114 and rough surfaces 116.

Generally, the zipper tape 111 extends to corners 154 where rough surfaces 116 and end edges 114 meet. Zipper tape (or "zip tape") is generally formed from a roll of "liner board" which is approximately three times thicker than the bundling tape, and which is generally more rigid and stronger than the bundling tape.

The prior art bundling tape 110 is generally an elongated strip of paper, or other suitable material, which may have adhesive pre-coated across its entire bottom surface before application to the wallboard; in the alternative, the zipper tape back surface, the exposed portions of the end edges 114, and the portions of rough surfaces 116 adjacent to corners 154 may all be coated with adhesive so that bundling tape 110 may be adhered to the zipper tape and wallboard. Usually bundling tape 110 is applied at both ends of a bundle to form the complete wallboard package which is shipped.

When a carpenter is ready to use the prior art wallboard package, sheets 117 and 119 are separated by removing zipper tape 111 along with the center portion 134 of the bundling tape 110. To remove zipper tape 111 and center portion 134 of bundling tape 110, the carpenter must grip a first end 140 of zipper tape 111 and pull it away from edges 114; this leaves behind an upper band 132 and a lower band 135 of bundling tape 110. Bands 132 and 135 which remain behind have irregular rough edges 136, and the bundling tape 110 which remains attached to end edges 114 may interfere with the ability to align sheets 117 or 119 with the edge of other sheets or to join closely with flat surfaces. The zipper tape and attached center portion 134 of bundling tape 110 is usually thrown away, although in some cases, it may be recyclable.

The process of producing the prior art wallboard bundles requires special equipment to apply the zipper tape, and then to apply bundling tape over the zipper tape and to the edges and surfaces of the wallboard sheets. Since the zipper tape is approximately three times as thick as the bundling tape, but the rolls of the former and latter usually have equal diameter, it is usually necessary to stop the manufacturing process three times to add new rolls of zipper tape for every one roll of bundling tape. Furthermore, it is necessary to carefully align the zipper tape so that the zipper tape covers the gap between the sheets of wallboard; this is so the bundling tape will not adhere to the end edges 114 in such a fashion that fragments of bundling tape remain across the gap after removal of the zipper tape. If sufficiently large portions of bundling tape remain attached across the gap, the wallboard pieces will not separate; use of a knife or sharp knife or sharp object would then be necessary to cut the bundling tape, and the cutting instrument may damage the wallboard.

The zipper tape is not only more difficult to apply, requiring extra equipment and extra processing steps, but is also more expensive due to the increased amount of material and labor required; zipper tape increases the amount of material which is thrown away and also increases shipping weight. Furthermore, the prior art zipper tape frequently leaves behind portions of bundling tape on the end edges of the wallboard, which require removal in order to facilitate better engagement with an adjacent sheet edge or to reduce the size of cracks in a wall or ceiling.

There is thus a need for a wallboard bundling tape and bundling method which, in some embodiments of the invention, can dispense with the zipper tape of the prior art; yet also be easy to apply and remove, but which is less capable of accidental gluing of the gap between the wallboard sheets in a bundle or which is not capable of leaving substantial amounts of tape on the edges of the wallboard pieces after they are separated. However, other embodiments of the present invention still employ a zipper tape in unique combination with other components or steps, and further include novel apparatus and methods for making and using bundling tape disclosed and claimed herein.

SUMMARY OF THE INVENTION

The present invention, which encompasses novel bundling tapes and methods for fastening sheets of material together, includes, in one or more preferred embodiments, the provision of a tape which is an elongated strip that has at least two rows of perforations dividing the tape into three lengthwise extending bands. As used and understood in this specification and claims, the term "perforation" is also intended to encompass a thinner or otherwise weakened material location whether or not a through opening or hole exists at said location. These bands comprise a first band and a second band located between the edges of the tape and the perforations, and a center band or tear strip (which can include a zipper tape) sandwiched between the first and second bands and the two rows of perforations. In the preferred embodiments, the center band or tear strip is generally wide enough to encompass most or all of the combined width of the sheet edges and gap therebetween in a two sheet bundle of sheets. Adhesive need generally be applied only to the surfaces of the first band and second band; there may or may not be adhesive on the center band. The center band is easily removed by grasping one end of it and tearing it from the strip along its perforations.

It is therefore an object of the present invention to provide new and improved bundling tapes, and methods and apparatus for their use and/or manufacture in fastening sheets of material together, which are inexpensive to produce, easy to apply, and which permit easy separation of the sheets held together in bundles by the bundling tapes.

It is a further object of the present invention to provide bundling tapes which do not adhere to any substantial portion of the edges of the sheets which are fastened together by the tape.

It is a further object of the present invention to provide bundling tapes which can be removed after application to a bundle with or without the use of an additional "zipper" tape or other tearing aid.

It is still a further object of the present invention to provide bundling tapes which can be used to fasten sheets of material together in a bundle in fewer process steps and with less equipment than the prior art.

Other objects and advantages of the subject invention will become apparent from the accompanying drawings and detailed description in which like reference numbers are used for the same parts as illustrated in the various figures.

DETAILED DESCRIPTION OF THE INVENTION

Figure 2:
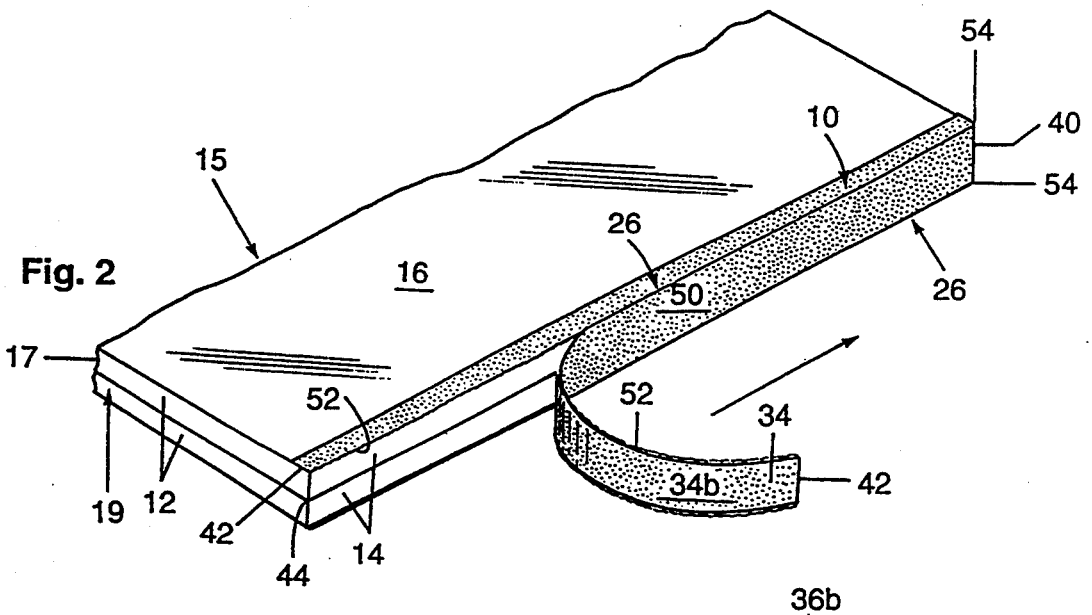
FIG. 2 is a perspective view of a first preferred embodiment of a wallboard bundle formed with a first preferred embodiment tape of the present invention, showing partial disengagement of a portion of the tape which does not include a zipper tear strip ("zipper tape" or "zip tape")

FIG. 2 illustrates a wallboard bundle 15 utilizing the bundling tape 10 comprising a first preferred embodiment of the present invention. An upper sheet 17 lies upon a lower sheet 19. Both sheets 17 and 19 are generally rectangular in shape, and have side edges 12 and end edges 14; the edges of sheets 17 and 19 generally being co-planar. End edges 14 meet substantially planar, rough or coarse surfaces 16 at corners 54. Sheets 17 and 19 are arranged so that the rough or coarse surfaces 16 face outward and the smooth surfaces (not shown) are adjacent to, and facing, one another. A gap 44 may be seen between sheets 17 and 19, and is due to manufacturing irregularities and/or to the paper coating applied to the wallboard sheets which may make corners 54 slightly rounded, rather than perfectly square.

The wallboard sheets are generally made from gypsum or other suitable materials. The rough surfaces are usually a less refined grade of paper. The end and side edges are generally planar.

The wallboard sheets are preferably shipped in bundles of two, with the smooth surfaces facing one another and the rough surfaces facing outward. Thus, the smooth surfaces are protected from damage during shipping; since the rough surfaces are generally not visible in the finished wall or structure, nicks and scratches in the rough surfaces caused by shipping and handling do not pose a problem. On the job site, wallboard is frequently cut to conform to architectural structure limitations, but the cut edges are generally not visible in the completed wall or structure.

Figure 3:
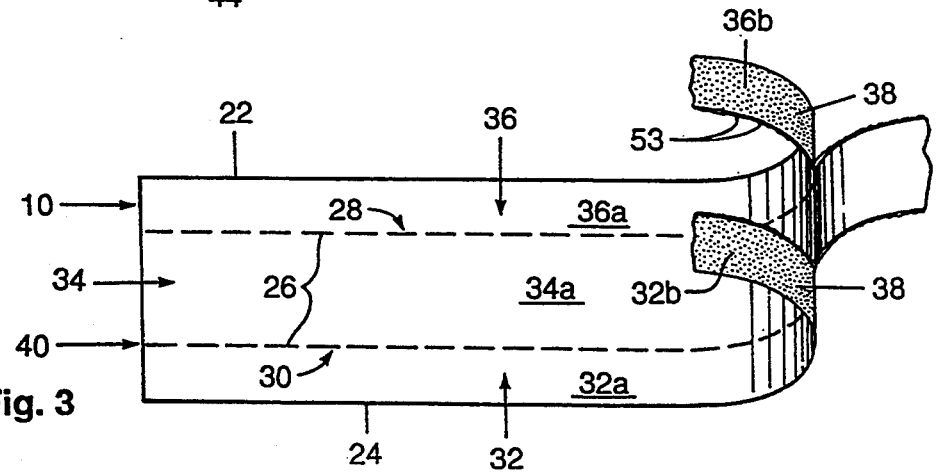
FIG. 3 is a perspective view of said first preferred embodiment tape of the present invention, with a portion of the tape folded back upon itself to show the bottom surface of the tape as well as partial disengagement of the band portions forming the tape.

With further reference to FIG. 3, the first preferred embodiment of bundling tape 10 is illustrated; tape 10 is in the shape of a generally rectangular, elongated strip or web with a first edge 22 and a second edge 24 which are substantially parallel to each other; edges 22 and 24 are also substantially parallel to rows of perforations or tear lines 26. Perforations 26 run from the first end 42 to the second end 40 of tape 10. A first row 28 of perforations 26 runs substantially parallel to first edge 22 to form a first band or securement strip 36. A second row 30 of perforations 26 runs substantially parallel to first row 28 and to second edge 24 forming a second band or securement strip 32. Thus, a center band or tear strip 34 is located between first row 28 and second row 30 of perforations 26. Bands 32, 34 and 36 have substantially co-planar upper surfaces **32*a*, 34*a* and 36*a*, and substantially co-planar bottom surfaces 32*b*, 34*b* and 36*b*. Adhesive 38 is only applied to bottom surfaces 36*b* and 32*b* of first band 36 and second band 32. There is no adhesive on either upper surface 34a or bottom surface 34b of center band 34. The perforations 26 (or "perfs") in tape 10 ("perf tape") enable bands 32, 34, and 36 to be separated in a fashion similar to the way stamps may be torn from a sheet of stamps. The selvage, or border, about tape 10 is generally smooth, while the edges 52, which result from the separation of center band 34 from first band 32 and/or second band 36 are perforated. The perforated edges 52 have regular protuberances 53** which are preferably as small as possible.

Adhesive 38 may be a corn starch adhesive, a polyvinyl acetate or a standard gummed adhesive, such as is used on envelopes; any other suitable adhesive which is capable of bonding tape 10 to the sheets of material which are to be bundled together may also be used.

The tape 10 may be made from a bleached kraft paper, although other cellulosic or fibrous material may be used; it is also possible to use metal foils or plastics for the tape, although it may be necessary to use different adhesives depending on the type of material used to make the tape.

Figure 1:
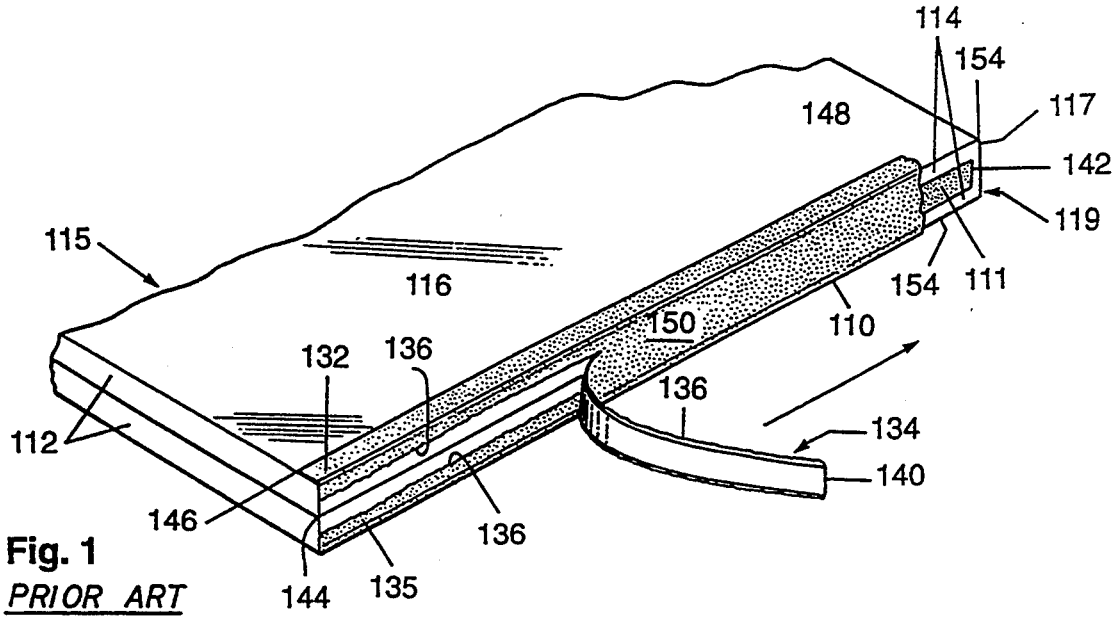
Fig. 1 PRIOR ART
FIG. 1 is a perspective view of a portion of a prior art wallboard bundle showing partial disengagement of the bundling tape and zipper tape.

Tape 10 may be applied to sheets 17 and 19 in a one-step process similar to the prior art processes, except that the additional equipment and steps necessary to apply the zipper tape over gap 44 is no longer necessary. The prior art processes required that the zipper tape 111 cover gap 144 so that there would be no accidental bonding of bundling tape 110 across gap 144 without intervening zipper tape 111. The new process involves the application of the uncoated bottom surface 34b of center band 34 across end edges 14 on sheets 17 and 19. In one embodiment, it is preferred that center band 34 have a width which is approximately equal to the combined width of end edges 14 on sheets 17 and 19 with gap 44; thus, rows 28 and 30 of perforations 26 would be approximately aligned along corners 54. First band 36 and second band 32 are preferably ½ inch in width, and preferably the adhesive 38 on the bottom surfaces 32b and 36b would adhere to rough surfaces 16 only. End surface 50, which is essentially upper surface 34a in the preferred embodiment, would face outward from the combined edges 14 so that information, such as the name of the manufacturer or retailer, grade or type of wallboard and relevant patent numbers, can be seen printed on end surfaces 50 (in the same fashion as information printed on the prior art surface 150 shown in FIG. 1).

In the preferred method of applying tape 10, first band 36 would be applied to a first or upper sheet 17 and second band 32 would be applied to a second or lower sheet 19. This may be performed sequentially or simultaneously. Tape 10 would preferably be applied at both ends of a bundle to form a completed wallboard package. The completed wallboard packages or bundles are then usually stacked so that pressure from upper bundles helps to ensure that bands 32 and 36 adhere tightly to the rough surfaces 16.

Although it is preferred that none of the adhesive coated bottom sides 32b and 36b of bands 32 and 36 be applied to end edges 14, the invention would still work better than prior art tapes if this were the case, provided that neither band 32 or 34 were to be applied across gap 44; however, this is easily avoided due to the width of center band 34 and with correct alignment of the roll of tape 10 which is to be applied to the end edges 14 of the wallboard.

To separate the wallboard pieces in a bundle, a carpenter or other user would grasp center band 34 at first end 42 and pull the center band 34 away from bands 32 and 36, thus tearing tape 10 at perforations 26. Bands 32 and 36 will remain adhered to end edges 14, but in a preferred mode the perforated edges 52 would be aligned with corners 54 so that only the regular protuberances 53 would project over or beyond the edges 14. Protuberances 53 should not substantially interfere, in the preferred embodiment, with the ability of the end edges 14 to be aligned with the side edges or end edges of another piece of material.

Although the first preferred embodiment of tape 10 is intended for use at the end edges of bundles of two sheets of wallboard, it is envisioned that tape 10 could be used about side edges 12 instead of end edges 14, or about side edges 12 and end edges 14. Furthermore, it is also envisioned that tape 10 could be used to bundle together a wide variety of sheet-like materials, or to bundle a plurality of sheets located between a lowermost and an uppermost (or a "first" and a "second" sheet) with the bands 32 and 36 attached to the outer surfaces of the uppermost and lowermost sheets. These same types of different uses are also envisioned for the additional preferred tape embodiments next to be described.

The perforated tape 10 first preferred embodiment, which is described above in connection with FIGS. 2 and 3, can provide superior results under proper circumstances since it is much easier to separate wallboard sheets in bundles by simply removing the center band. This is surprising because the weight of the wallboard sheets and the large opposing tensile forces exerted by them on the bundling tape are such that perforated tape would not normally be considered usable as a wallboard bundle packaging component, even though perforated tape has been used in the prior art to seal carton lids lying in the same plane. However, at times the center band 34, if not carefully pulled, can "dovetail" or tear inwardly and break, so that it may be necessary to restart the tear from the opposite end of the center band, or to tear off the remaining pieces of the center band from the perforation edges 52. While the perforated tape 10 can provide substantial advantages, even if it is necessary to remove the central band 34 in several pieces, it also is desired to provide additional preferred perforated tape embodiments that include a zipper tape and which, when applied to a wallboard bundle, will evenly and cleanly tear at the perforations without leaving any center band pieces which would have to be later removed.

A prior art laminated tape for hand repairing of gypsum boards is known which utilizes a heavyweight standard zipper tape (basis weight of 42 lbs per 1,000 sq. ft.) that is laminated to a non-perforated bundling tape. However, the additional preferred tape embodiments disclosed herein combine the features of a zipper tape with the features of the perforated bundling tape in order to obtain the complete tear and fast separation capabilities provided by the zipper tape, as well as to obtain the clean and even tear possible with the perforated tape.

Moreover, it has been determined that when a standard 42 lb. zipper tape is laminated to a perforated wallboard bundling tape, a laminated tape roll of 24 inches in diameter typically has less than 3,000 linear feet per roll (standard 42 lb. zipper tape has a basis weight of 42 pounds per 1,000 square feet, "lbs. per 1,000 sq. ft."; it is also commercially available in the form of liner board and kraft paper at 55 lbs. per 1,000 sq. ft. and lower basis weights). Further, there can be difficulties in aligning and adhering the standard heavy zipper tape to the center band of the perforated bundling tape. In contrast, a normal non-laminated bundling tape roll of 24 inches in diameter typically has about 7,000 linear feet. In order to gain more linear feet per roll of laminated tape, a zipper tape lighter in weight (e.g., thinner) than 42 pounds per 1,000 square feet is therefore desirable, although it would be reasonable to believe that the lighter zipper tape (or "Zip Tape") would not provide sufficient reinforcement to the center band of the perforated tape to result in a clean and even tear at the perforations. Surprisingly, however, when a lighter zipper tape having a basis weight as low as 15 to 20 lbs. per 1,000 sq. ft. (for example, about 16.7 lbs. per 1,000 sq. ft.), is laminated to a perforated bundling tape of approximately the same basis weight, the combined center band and zip tape are strong enough to tear evenly and cleanly. Additionally, a 24 inch diameter roll of such laminated tape, having zipper tape and perforated tape basis weights of about 16.7 lbs. per 1,000 sq. ft., respectively, provides approximately 4,000 linear feet.

Figure 4:
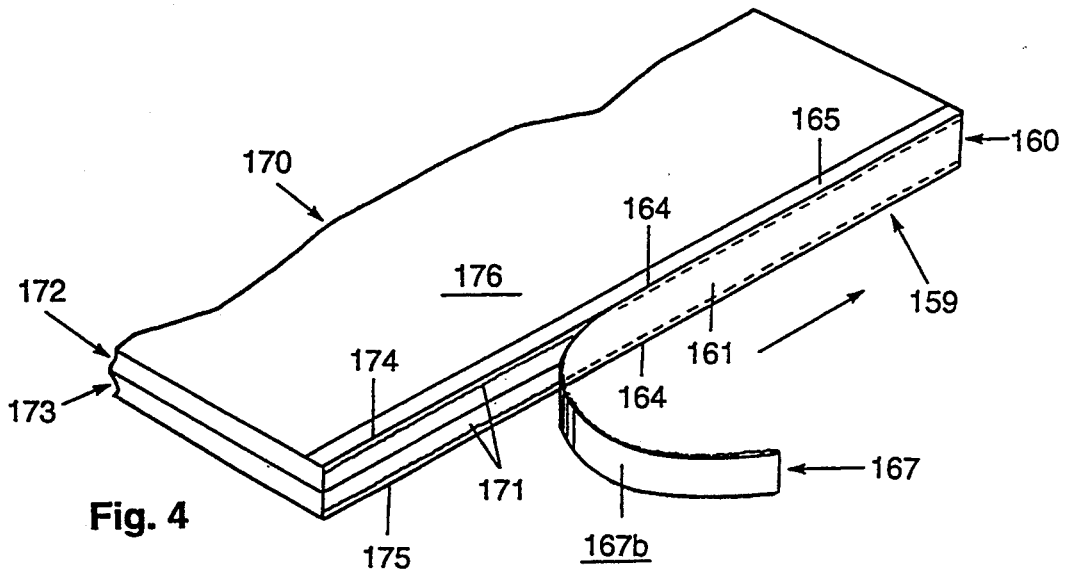
FIG. 4 is a perspective view of a second preferred embodiment of a wallboard bundle formed with a second preferred embodiment tape of the present invention, showing partial disengagement of a portion of the tape which includes a zipper tear strip.
Figure 5:
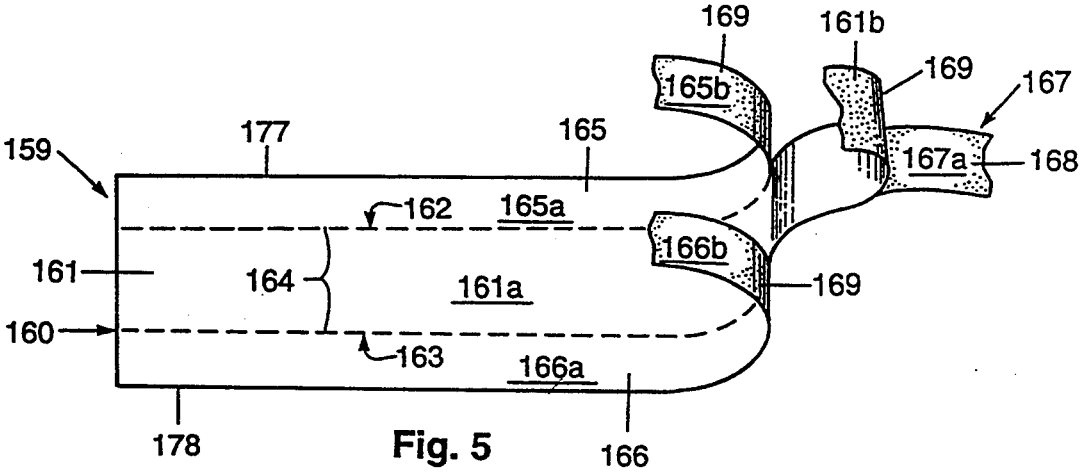
FIG. 5 is a perspective view of said second preferred embodiment tape of the present invention, with portions of the tape folded back upon itself to show the bottom surface and zipper tear strip as well as partial disengagement of the band portions forming the tape.

Accordingly, a second preferred bundling tape 159 embodiment is shown in FIGS. 4 and 5 which has a top bundling tape strip 160 that has a center band 161 separated by rows 162 and 163 of perforations 164 from outer bands 165 and 166, where the center band 161 is laminated to a zipper or tear tape strip 167. This combined tape 159 may be referred to as a laminated tape, reinforced tape, combined tape, zip and tape, or by other convenient terms which may develop. Preferably, the zipper tape strip 167 has a basis weight which is approximately equal to the basis weight of the perforated tape strip 160, without taking into account the additional weight of any adhesive that may be applied to the perforated tape. In addition, the zipper tape strip 167 preferably has a width not greater than but approximately equal to or slightly less than the width of the center band 161.

Under certain circumstances, standard wallboard bundles bound together using a perforated tape, such as perforated tape 10, having a basis weight of about 16.7 lbs. per 1,000 sq. ft, in which the perforated tape center band is laminated to a zipper tape having a basis weight of about 16.7 lbs. per 1,000 sq. ft. exhibited some dove-tailing or irregular tearing of the center band of the perforated bundling tape during removal of the center band, especially when users attempted to simultaneously remove more than one bundling tape center band from two or more wallboard bundles.

It has been discovered that the occurrence of such dove-tailing or irregular tearing of the center band from a wallboard bundle held together with perforated tape having its center band laminated to a zipper tape can be minimized by the use of a zipper tape having a basis weight greater than 20 lbs. per 1,000 sq. ft., and preferably between 20 lbs. per 1,000 sq. ft. and about 42 lbs. per 1,000 sq. ft. In a preferred embodiment, a zipper tape having a basis weight of about 26 lbs. per 1,000 sq. ft. is adhered to the center band of a perforated bundling tape, such as tape 10, with the perforated bundling tape having a basis weight of about 16.7 lbs. per 1,000 sq. ft. It has been discovered that this tape optimizes the number of linear feet per 24 inch diameter roll of the combined tape, while providing a perforated tape having a sufficient basis weight for wallboard bundling and also providing a zipper tape having sufficient basis weight to minimize uneven tearing at the perforations of the perforated tape while removing the center band from a wallboard bundle held together with the perforated tape. A 24-inch diameter roll of laminated tape with a 26-lb. zip tape and 16.7 lb. perf tape contains 3100 linear feet of tape; if the tape is 2.5 inches in width, such a roll weighs about 19 pounds.

Use of a zipper tape having a basis weight greater than 20 lbs. per 1,000 sq. ft. allows for the use of water-based adhesive to adhere the zipper tape to the center band of the perforated tape. Problems associated with the use of water-based adhesives when using zipper tape having a basis weight of lower than 20 lbs. per 1,000 sq. ft. are discussed below.

While liner board useful in making zipper tape is also commercially available at basis weights of 33, 42, and 55 lbs. per 1,000 sq. ft., and while it is envisioned that such thicker zipper tapes may be used with perforated tape, such as perforated tape 10, it is noted that such thicker zip tapes would require thicker diameter rolls to provide the same number of linear feet of combined tape than for rolls of combined tape having a zipper tape of lower basis weight.

Use of a heavier basis weight perforated tape is also envisioned (e.g., up to 25 lbs. or greater per 1,000 sq. ft.), with it being understood that a thicker perforated tape than about 16.7 lbs. per 1,000 sq. ft. will result in less tape on a roll of tape than a thinner tape on a roll of the same diameter, and higher basis weight tape is more expensive. Further, a thicker perforated tape may require a greaser degree of perforation, or a thicker tear strip in order to get a clean tear when removing the center band.

In one version of this tape 159 embodiment, it is possible to laminate the zipper tape strip 167, with adhesive 168 on its front surface 167*a*, to the bottom side or surface 161*b* of the center band of the perforated tape strip 160 which has not been pregummed (e.g., has had no adhesive of any kind applied to the bottom surfaces 161*b*, 165*b* and 166*b* of the perforated tape strip 160). In another version of this embodiment, the perforated tape strip 160 has adhesive 169 previously applied completely across all of its bottom surfaces, and the zipper tape strip 167 is adhered to the adhesive 169 on the bottom 161*b* of the center band 161.

Although gum adhesive (dextrin or cornstarch based adhesives which are water activated) can be used as adhesive 168 or 169 to laminate the zip tape strip 167 to the center band 161 of the perforated tape strip 160, poor adhesion of the center band to the zip tape is likely to result. Therefore, it is preferred to use a resin product, such as a polyvinyl acetate homopolymer emulsion, as the adhesive 168 to adhere the zip tape 167 to the center band 161 of the perforated tape strip 160. One such suitable resin product is called Adhesive 606 which is available from the Port City Company in Wilmington, N.C. The resin adhesives tend to be more viscous than the gum adhesives, and therefore do not penetrate as deeply into the zip tape. A possibly suitable non-resin adhesive 168 is Product 0176 from the H. B. Fuller Company, which is cheaper and may be viscous enough to provide a sufficiently strong bond, even though it is a water-based product.

Early experiments demonstrated that it is less desirable to rely upon a water-based adhesive for lamination of the zip tape strip to the center band of the perforated tape strip. The water needed to activate such an adhesive is readily absorbed into the zip tape, which limits the ability of the water to dissolve a water activated gum adhesive and to adhere the zip tape to the center band of the perforated tape. Further, since the laminated tape product 159 is to be formed into rolls, any excess moisture in its zip tape 167 component could cause the tape 159 to adhere to itself, and to make it difficult or impossible to subsequently use the laminated tape roll. This problem is noted when zip tape having a lower basis weight is used, generally below about 20 lbs. per 1,000 sq. ft., and particularly around 16–17 lbs. per 1,000 sq. ft. or less. Therefore, while it is possible to use a gum adhesive to hold the zip tape strip 167 to the center band 161 of the perforated tape strip 160, care should be taken not to use too much water in adhering the zip tape to the perforated tape with a gum adhesive, and improved and unexpected results are achieved by using a resin product as the adhesive 168 on the zipper tape strip 167.

It has also been surprisingly discovered that a water activatable adhesive, such as but not limited to a gum adhesive, may be used to adhere a zip tape, such as strip 167, to the bottom of the center band, such as bottom **161*b* on band 161, of a perforated tape strip, such as strip 160**, when using a zip tape having a basis weight of greater than about 20 lbs. per 1,000 sq. ft. In a preferred embodiment, a zip tape formed of liner board having a basis weight of about 26 lbs. per 1,000 sq. ft. is adhered to the bottom of the center band of a perforated tape strip using a water activatable adhesive. The basis weight of the zip tape is sufficient to avoid adherence of the tape to itself in a laminated tape roll ("blocking"), while the zip tape has sufficient strength to provide for a clean tear along the perforations when the tape is used in bundling wallboard. Further, a greater number of linear feet of laminated tape can be stored on a roll when using a zip tape with a basis weight of 26 lbs. per 1,000 sq. ft. than on a roll of the same diameter formed using prior art zip tape having a basis weight of 42 lbs. per 1,000 sq. ft.

A gum adhesive 169 may normally be applied at least to the bottom surfaces **165*b* and 166*b* of the outer bands 165 and 166 of the perforated tape strip 160 prior to adhering the zip tape strip 167 to the center band 161 with a resin adhesive 168. This gum adhesive 169 is later used to adhere these outer bands to the wallboard bundle. It is further contemplated, as specifically shown by FIG. 5, that the gum adhesive 169 may also be applied both to the center band 161 as well as to the outer bands 165 and 166 of the perforated tape strip 160 prior to adhering the zip tape strip 167 to the center band with a resin adhesive 168. Alternatively, the gum adhesive 169 may be applied to the outer bands 165 and 166 after the zip tape strip 167 has been adhered by resin adhesive 168 to the center band 161**.

One of skill in the art will immediately recognize that numerous variations can be made in the weight of the zipper tape strip 167 and perforated tape strip 160, in the number of perforations 164 per inch forming the perforations on the bundling tape strip 160, and in the separation between the perforation rows 162 and 163, without departing from the spirit of the present invention.

In the perforated tape-zipper tape bundle embodiment shown in FIG. 4, a wallboard bundle 170 is formed using the perforated tape strip 160 to which the zipper tape strip 167 is adhered. Strip 167 is held between the center band 161 of the perforated tape and the aligned, substantially co-planar end edges 171 of two stacked rectangular wallboard sheets 172 and 173 in the bundle. Like bundle 15 in FIG. 2, the FIG. 4 wallboard sheets 172 and 173 have smooth surfaces facing each other and outwardly facing rough surfaces 176 to which the outer tape bands 165 and 166 are adhered. Of course, additional bundles 170 can be stacked on top of the single bundle 170 shown in FIG. 4, so that the tape outer bands 165 and 166 are firmly pressed against rough surfaces 176. The wallboard sheets 172 and 173 also can have their opposite or opposed co-planar and aligned edges (not shown) fastened with another strip of the bundling tape 159. In another version of this FIG. 4 bundle embodiment, however, there is no adhesive between the center band 161 and the zipper tape 167 that is used to bond them together. For this latter version, the zipper tape 167 will first be held or placed on the edges 171 of the wallboard bundle, with adhesive then being applied to or activated on the bottom surfaces of the outer bands 165 and 166 of the perforated tape 160 (which may or may not have pre-applied adhesive) just prior to adhering the perforated tape 160 to the wallboard bundle over the zipper strip 167. Therefore, FIG. 4 may also be understood to show a wallboard bundle wherein the zipper tape strip 167 is not adhered or otherwise attached to the perforated bundling tape strip 160, but is only located between the center band 161 of strip 160 and the wallboard edges 171 where it will also act in conjunction with perforations 164 to further facilitate the easy removal of said center band.

In still another version of the FIG. 4 bundle embodiment, the adhesive can instead be applied to the rough surfaces 176 of the pairs of wallboards forming a bundle, with the adhesive being applied just near the rough surface corners 174 and 175, so that the perforated tape 161 (which may have no adhesive) and the zipper tape 167 (which may or may not be adhered to the perforated tape) can be fastened over edges 171 to hold the bundle together. Thus, the zipper tape 167 can be utilized with ungummed perforated tape 160 without necessarily adhering the zipper tape to the center band of the perforated tape, and the adhesive can be applied to the rough surfaces of the wallboard bundle or to the outer bands of the perforated tape just prior to taping the bundle together with the zipper tape being held between the center band 161 and the edges 171 of the wallboard sheets.

In some instances, aligning the rows 162 and 163 of perforations 164 in the bundling tape strip 160 with the upper and lower edge corners 174 and 175 of wallboard bundle 170, as is similarly illustrated by the perforations 26 on corners 54 in FIG. 2, may encourage undesirable premature tearing or breakage of the tape 160. While such a wallboard edge corner alignment of perforation 164 is certainly feasible and provides the stated advantages of the present invention, it may be more desirable to provide a center band 161 having a width greater or less than the total thickness of the wallboard sheets 172 and 173 in the bundle. Thus, a wider center band 161 can extend over the rough surfaces 176 of both wallboard pieces in the bundle, and upon removal of the center band 161 (which may be assisted by one or more additional tear strings or pieces of zipper tape), the wallboard sheets 172 and 173 will separate without any tape extending beyond the sheet corners 174 and 175. In the alternative, however, it may be even more preferable to remove a center band 161 having a width which is slightly less than the total thickness of the edges 171 of the wallboard bundle 170, as shown in FIG. 4. Here, the smaller center band 161 is centered only on the edges 171 of the wallboard bundle and just inside the corners 174 and 175, so as to leave a small overlapping piece of the adhered tape outer bands 165 and 166 on each of these edges. However, this small overlap, due to the perforations 164 in the tape, will have a uniform width and will not have the same degree of undesirable effects as the ragged edge produced by using an unperforated tape.

It has also been discovered that it is advantageous to provide a zip tape strip 167 having a width slightly less than the width of the center band 161 of the perforated tape strip 160 to which it is laminated. It is believed that this relationship will result in fewer instances of premature breakage of the perforations 164 due to movement of the wallboard bundles. For example, a perforated tape strip 160 having a center band 161 which is ¾ inches (6/8 inches) in width could have a zip tape strip 167 of ⅝ inches wide that is adhered equidistantly between the perforations 164 separating the center band 161 from the outer bands 165 and 166 of the perforated tape strip.

In connection with preferred methods and apparatus for producing the laminated perforated tape embodiment of the present invention, and for laminating a zip tape to the center band of the perforated tape, the following equipment and methods are shown and described.

Figure 8A:
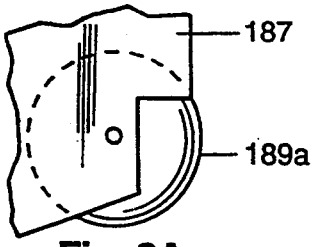
FIGS. 6, 7, 8, 8A and 8B show a first preferred embodiment of apparatus for making the second preferred tape embodiment depicted in FIGS. 4 and 5.
Figure 8B:
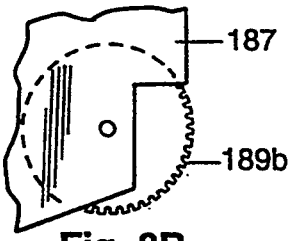
Figure 8:
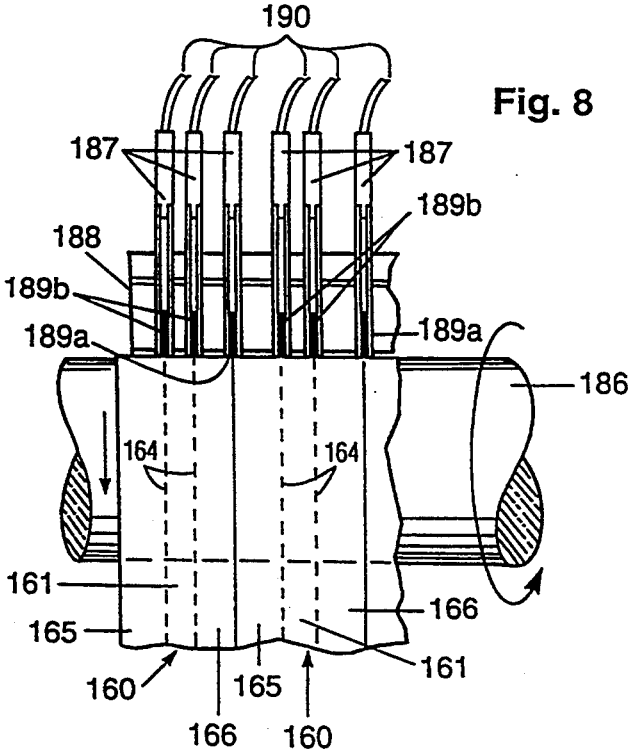
Figure 6:
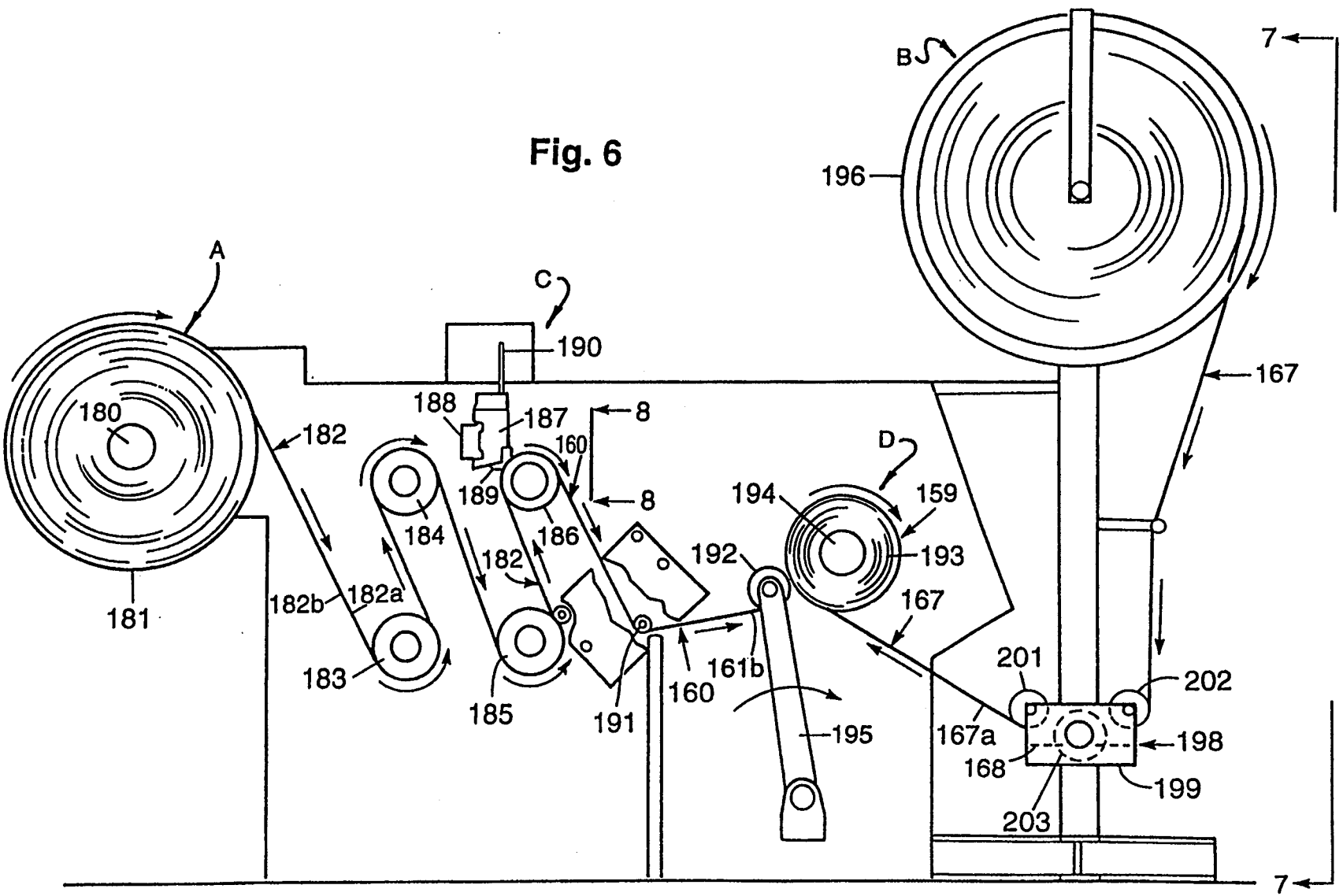
Figure 7:
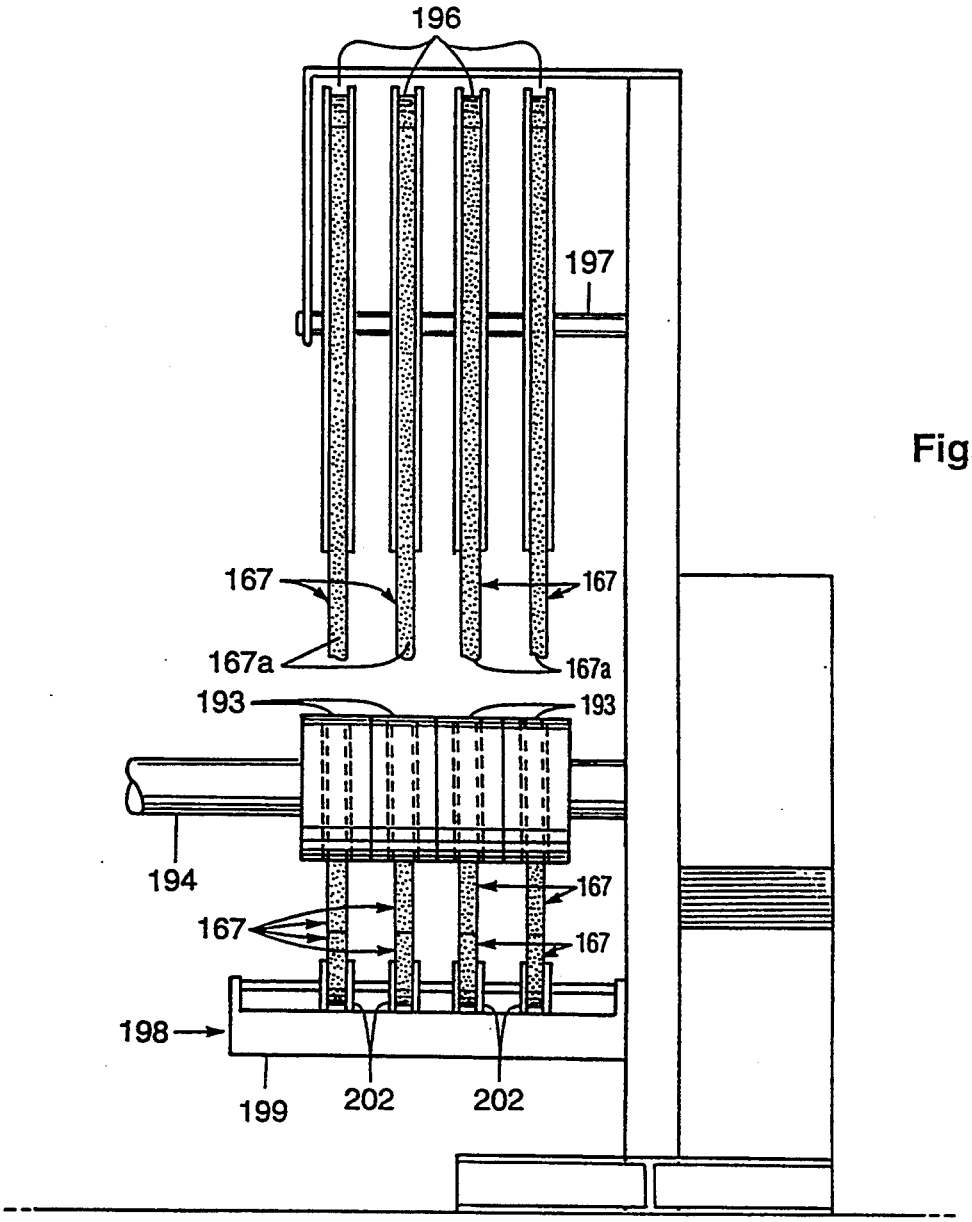

FIGS. 6, 7 and 8 show a first preferred embodiment of apparatus for making the laminated tape 159 depicted in FIGS. 4 and 5. This apparatus includes a bundling tape input station A and a zipper tape input station B. The bundling tape input station A generally consists of a free wheeling (not driven) unwind shaft 180 in FIG. 6 on which is mounted a relatively wide single roll 181 of a pre-gummed, non-perforated white kraft paper web 182 from which the perforated top bundling tape strip 160 will be processed. This paper, without adhesive thereon, typically has a basis weight of around 16–17 lbs. per 1,000 square feet. It can be obtained with its bottom side or surface **182*b* entirely pre-coated with a water activated gum adhesive such as a corn starch-/dextrin based adhesive which would add about 5 lbs. per 1,000 square feet. This is the adhesive 169 that was described in connection with FIG. 5 and which is used, when activated with water, to attach the outer bands 165 and 166 to the wallboard sheets 172 and 173 in the bundle of FIG. 4. The top side or surface 182*a* of web 182 may have printed matter thereon which also will appear on the top side of each tape 159**.

The width of the solid bundling tape web 182 on roll 181 is at least two or more times the width of the finished perforated laminated bundling tape 159. In FIG. 6, web 182 is assumed to be four times wider than tape 159. When a rewind shaft 194 at a tape rewind station D is rotated, the bundling tape solid wide web 182 is withdrawn from roll 181 and then passed around idler tension control rollers 183, 184 and 185 to a smooth surface idler anvil roller 186 located at a slitter-perforator station C. Here, the solid wide web 182 is slit into four parallel bundling tape strips 160, in each of which is also simultaneously cut the two rows 162 and 163 of perforations 164 shown in FIGS. 4 and 5.

This slitting and perforating operation at station C is best viewed in FIG. 8, where the slitter-perforator station C is shown to also include a group of knife holders 187 which are attached to a dove tailed support member 188 and are spaced in a row along the width of anvil roller 186 over the bundling tape web 182 from roll 181. Each knife holder 187 carries a vertically disposed, rotatable cutting wheel knife **189*a* or 189*b* which is forced against web 182 and anvil 186 by air pressure applied via an individual pipe 190 from an appropriate source of air. In FIG. 8, the cutting wheel knives 189*a* have continuous unbroken peripheries, as shown in FIG. 8A and are appropriately spaced from each other for slitting the broad web 182 into parallel narrow strips 160 of bundling tape paper, each tape strip 160 having a width equal to the distance between edges 177 and 178 in FIG. 5. On the other hand, the cutting wheel knives 189*b* have serrated or toothed peripheries, as shown in FIG. 8B for cutting perforations 164 into web 182. They are grouped in pairs between cutting wheels 189*a* for placing the two perforated rows 162 and 163 in each narrow bundle tape strip 160 at the same time that these strips are being slit from web 182**.

Consequently, the bundling tape strip center band 161, and its outer bands 165 and 166 are formed at station C. Since both slitting and perforating are simultaneously performed by cutters 189 which are all held on support 188, the rows of perforations 164 can be precisely spaced and aligned with each other and with the edges of their respective strips 160. Knife holders 187 and cutting wheel knives 189 which are suitable for the above described purposes are commercially available, particularly from the Dienes Corporation of Spencer, Mass., whose "crush cut" type of holders and cutting wheels can be so employed in the slitter-perforator station C of FIGS. 6 and 8. Crush-cut tools for slitting and perforating are advantageous because they are quicker to set up and only one smooth surface anvil roller 186 is required. However, other types of cutting tools may alternatively be employed at station C.

Following the slitter-perforator operations at station C, the separate parallel perforated tape strips 160 pass around a stationary straight guide bar 191 and an idler roller 192 which are both wide enough to contact all of these strips. If necessary, a conventional bowed stationary bar may also be provided between anvil roller 186 and stationary straight bar 191, or perhaps provided in place of the latter, for contacting these strips 160 to prevent their overlapping while in motion. Strips 160 are then wound clockwise into individual rolls 193 of laminated tape 159 which are affixed on the driven rewind shaft 194 at the tape rewind station D. Idler roller 192 is supported by a pivoted arm 195 that is biased to maintain roller 192 in constant contact with each roll 193. As best shown in FIG. 7, there are four such rolls 193 on shaft 194 in the first apparatus embodiment, meaning that the slitter-perforator station C has cut four tape strips 160 from the input web 182, although only two such strips 160 are completely shown in FIG. 8.

As each of the four bundling tape strips 160 is wound onto its respective roll 193, an individual narrow zipper tape strip 167 is concurrently pressed against and adhered to the bottom side or surface **161*b* of the bundling strip's center band 161 so as to also be wound therewith onto roll 193, thus forming the finished laminated tape 159 of FIGS. 4 and 5. In the embodiment of FIGS. 6–8, each zipper tape 167 is pre-slit and is initially obtained from a different one of the four zipper tape supply rolls 196 shown in FIG. 7 which are freely mounted on an unwind shaft 197 at the zipper tape input station B. In order to put more linear feet of laminated tape 159 on roll 193, a relatively light zipper tape 167 is employed having a basis weight of about 16.7 lbs. per 1,000 square feet, which is approximately equal to the basis weight of the bundling tape 160 that was cut from web 182. The use of this lighter zipper tape also unexpectedly results in a laminated tape 159 that is strong enough to tear evenly and cleanly along its perforations 164 without dovetailing, even though it was previously anticipated that such a light weight zipper tape would not prevent undesirable dovetailing or uneven tearing. Furthermore, this lighter weight zipper tape 167 is cheaper in cost, less heavy to transport, and reduces the time and expense of replacing empty rolls 196 during the manufacturing process because more light weight tape 167** can be stored on these rolls.

After being unwound from its supply roll 196 by rewind shaft 194, but prior to its contact with a bundling tape strip 160 at the rewind station D, each zipper tape strip 167 has its front surface 167*a* coated with a suitable adhesive 168, preferably resin in nature, by a coating mechanism 198. In FIGS. 6 and 7, this coating mechanism 198 is comprised of a trough or container 199 for holding a quantity of suitable viscous adhesive 168, and a pair of flanged guide wheels 201 and 202 in tandem for each zipper strip 167. These guide wheels direct said zipper strip across the top of and in contact with a rotatable adhesive applicator wheel 203 that extends down into the adhesive 168. The guide wheels 201, 203 also direct their respective zipper tape strip 167 into proper alignment with the center band 161 of the perforated bundling tape strip 160 at the rewind station D. Applicator wheel 203 may be a single drum long enough to contact all of the zipper tapes 167, or it may comprise a group of individual narrow applicator wheels each contacting a different zipper tape strip 167. Typically, its outer cylindrical surface is knurled or otherwise is adapted to pick up and temporarily retain an amount of adhesive 168 thereon as the wheel 203 rotates through container 199. Thus, the movement of each zipper strip 167 across applicator wheel 203 will cause the latter to apply adhesive 168 to the tape's front side or surface 167*a*. As mentioned earlier, this coated zipper tape surface 167*a* presses against the bottom side or surface 161*b* of the center band 161 of bundling tape strip 160 at the rewind station D where the two tapes are wound together. The resin adhesive 168 that is carried by the zipper strip 167 will dry within a few minutes after the roll 193 is wound tightly.

It is also important to note that while the bottom side 161*b* of perforated strip 160 may already have a precoated water based adhesive 169 thereon because of having been cut from web 182, it is more desirable if not also necessary to use a resin adhesive for the purpose of producing an adequate bond between top strip 160 and zipper strip 167. This stronger resin bond also appears to be an important reason why a lighter weight zipper tape 167 can be used than would ordinarily be expected.

The first preferred apparatus embodiment of FIGS. 6–8 may be constructed using parts from conventional equipment, such as a center winder machine made by the Stanford Division of Man Roland Inc. (Salem, Ill.), with provisions for slitting and perforating the bundling tape strips 160, and also modified to hold the pre-slit zipper tape rolls 196, to apply adhesive 168 to the zipper tape strips 167, and to guide each zipper tape 167 into the proper position between the perforation rows 162 and 163. In the Stanford Center Winder Machine, the unwind shaft corresponding to shaft 180 in FIG. 6 can also be expanded to grip roll 181 and, moreover, it can move in and out of the FIG. 6 plane under control of sensing mechanism in order to keep web 182 properly aligned with other apparatus elements. However, the embodiment of FIGS. 6–8 is capable of producing only a limited number of laminated tape rolls 193 at the same time because the Stanford center winder machine can accommodate a bundling tape supply roll 181 which is only about thirty inches wide and twenty-four inches in diameter.

Accordingly, a second preferred apparatus embodiment is shown in FIGS. 9–12 which will permit a much larger number of longer laminated tape rolls to be produced by a novel combination of elements next to be described.

Figure 9A:
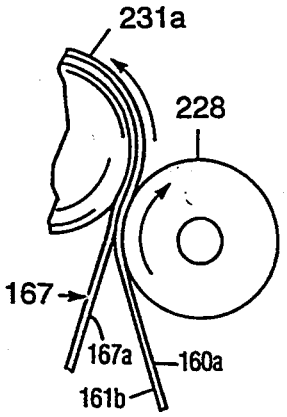
FIGS. 9, 9A, 9B, 10, 11 and 12 show a second preferred embodiment of apparatus for making the second preferred tape embodiment depicted in FIGS. 4 and 5.
Figure 9B:
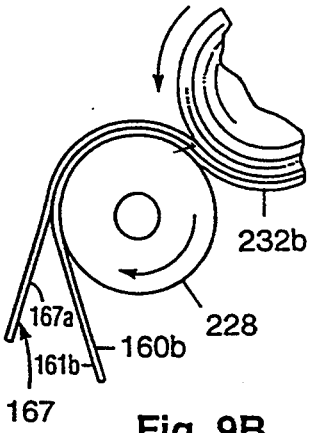
Figure 9:
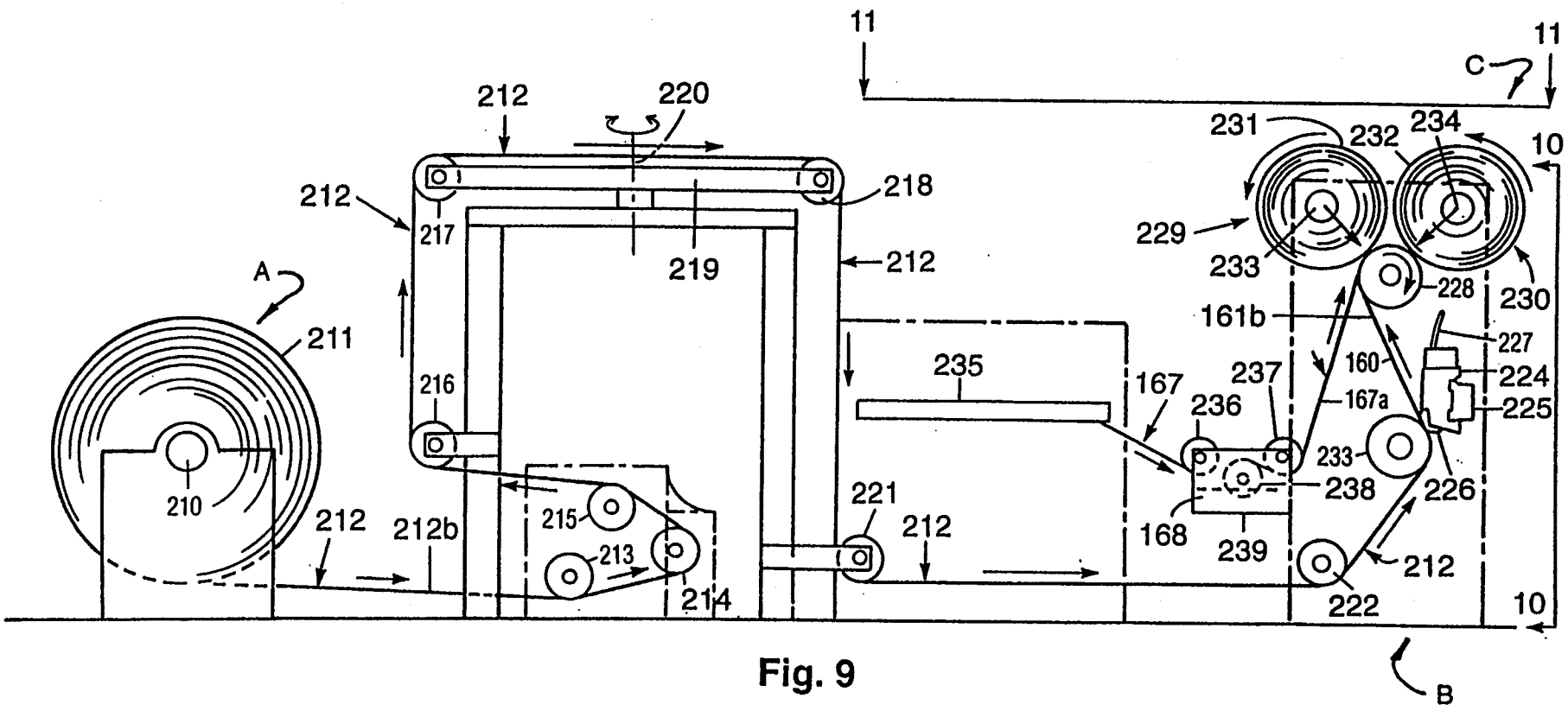

In the FIG. 9 elevation view, a bundling tape input station A includes a free wheeling unwind shaft 210 on which is mounted a single roll 211 of pre-gummed, non-perforated white kraft bundling paper in the form of a wide solid web 212, having a typical basis weight of around 16–17 lbs. per 1,000 square feet with no adhesive thereon. The length of shaft 210 and its stand height above the floor are designed so that it can accommodate a full roll of paper up to fifty inches wide and fifty to sixty inches in diameter. This solid, wide paper web 212, which can be obtained with water-based gum adhesive on its side 212*b*, is pulled from roll 211 by the tape rewind station C and passed around idler roller 213, tension control roller 214, idler roller 215 and idler roller 216 before passing over the uppermost idler rollers 217 and 218. Rollers 217 and 218 are supported in a horizontal frame member 219 which can be pivoted around a vertical axis 220 in response to sensor controlled mechanism (not shown) that operates to maintain the moving web 212 in proper alignment with other sections of the apparatus. These rollers 217 and 218, together with their supporting frame 219 and sensing mechanism, can be part of conventional and commercially available equipment such as an offset pivot guide device manufactured by the Fife company of Omaha, Nebr.

Figure 10:
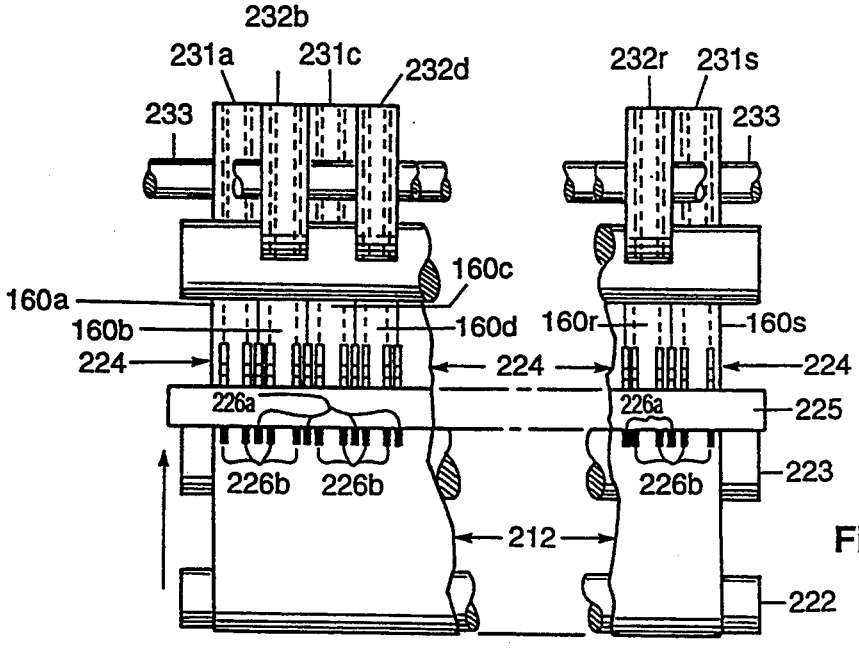

The wide solid web 212 next moves downwardly so as to pass around idler rollers 221 and 222 before reaching a slitter-perforator station B. As is also shown in FIG. 10, a smooth surface idler anvil roller 223 is located at this station which cooperates with a plurality of knife holders 224 spaced in a row along dovetail bracket 225. These holders 224 support crush cut knife slitter wheels 226*a* and crush cut knife perforation wheels 226*b* for slitting web 212 into a plurality of narrow, parallel bundling tape strips 160 that are also concurrently provided with the rows 162 and 163 of perforations 164. This is the same operation that was previously described in connection with the holders 187 and cutting wheels 189*a* and 189*b* which are shown in FIG. 8. In FIGS. 9 and 10, however, up to twenty 2.5" wide bundling strips 160 may theoretically be cut from a 50" wide solid web, but in practice only about 19 strips may be slit from a standard 47.75" wide roll after 0.25" of selvedge has been removed. Although each knife holder 224 is also shown to be vertically oriented in FIGS. 9 and 10, the holder may alternatively be rotated clockwise in FIG. 9.and thus horizontally oriented so that its air pressure input pipe 227 would generally lie in a horizontal plane. Of course, each cutting wheel 226 would still be vertically disposed. Each holder 224 also may be slightly lower so that its cutting wheel 226 would contact web 212 somewhat earlier in the web's passage around anvil 223. Other types of slitters and perforators may alternatively be used at station B.

Figure 11:
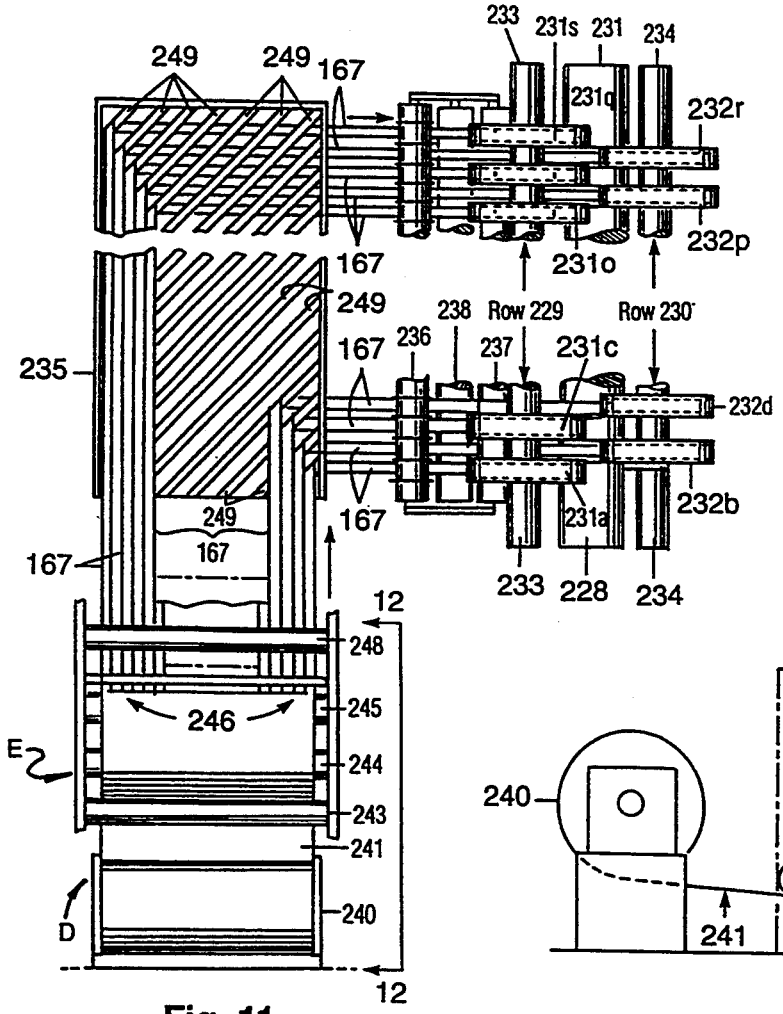

After being slit and perforated at station B, the parallel bundling strips 160, each including a center band 161 with a bottom side 161*b*, continue moving and pass around a driven winding drum 228 that also makes continuous contact with two parallel rows 229 and 230 of driven laminated tape rolls 231 and 232, respectively, at a tape rewind station C. As best shown in FIG. 11, row 229 consists of a plurality (e.g., ten) of laminated tape rolls 231 on a driven shaft 233, each roll 231 being spaced apart by about one tape roll width from adjacent rolls 231 on said shaft 233. Similarly, row 230 consists of a plurality (e.g., nine) of laminated tape rolls 232 on a driven shaft 234, where each roll 232 thereon also is spaced apart by about one tape roll width from adjacent rolls 232 on said shaft. Shafts 233 and 234 are also movable and biased by air pressure to press tape rolls 231 and 232 against winding drum 228. However, the laminated tape rolls 231 on shaft 233 in row 229 are staggered or alternated with respect to the laminated tape rolls 232 on shaft 234 in row 230, so that the tape rolls 231 and 232 appear to be interleaved when viewed as shown in FIG. 10. This staggered tape roll arrangement, which is found in commercially available equipment such as the Cameron duplex winding machine, permits one set of alternate bundling tape strips 160 from station B to be wound onto tape rolls in one of said rows 229 and 230, while the other set of alternate tape strips 160 are wound on tape rolls in the remaining row. For example, the set which includes alternate bundling tape strips 160*a*, 160*c* and 160*s* in FIG. 10 will first pass clockwise (as seen in FIG. 9) between winding drum 228 and tape rolls 231*a*, 231*c* and 231*s*, respectively, then will be respectively wound counterclockwise on said tape rolls 231*a*, 231*c* and 231*s*. Similarly, the other set which includes alternate tape strips 160*b*, 160*d* and 160*r* also pass clockwise (as seen in FIG. 9) between winding drum 228 and tape rolls 232*b*, 232*d* and 232*r*, respectively, then are respectively wound counterclockwise onto said rolls 232*b*, 232*d* and 232*r*.

As each of the bundling tape strips 160 is wound onto its respective rewind roll 231 or 232, an individual narrow adhesive-coated zipper tape strip 167 is concurrently pressed against the bottom surface 161*b* of the bundling strip's center band 161 so as to also be wound therewith onto the same roll, thus forming the laminated tape 159 of FIGS. 4 and 5. This operation is best depicted in FIGS. 9 and 11 which together show a plurality (e.g., nineteen) of parallel, spaced-apart zipper tape strips 167 pulled by tape rewind station C and emerging from a 90° redirect frame component 235 (later described), each strip to thereafter pass around the tandem guide wheels 236, 237 and over the adhesive applicator wheel 238 of a coating mechanism 239. In FIG. 11, the nineteen sets of guide wheels 237 and 237 are formed by flange pairs on a single drum, but individual wheels may instead be used as shown in FIG. 7. Applicator wheel 238 coats adhesive 168, preferably resin, on the front surface 167*a* of each zipper tape strip 167 which then moves to winding drum 228. There, one set of alternate zipper strips 167 respectively adhere to the one set of alternate bundling tape strips 160*a*, 160*c*, etc. for forming laminated tape rolls 231*a*, 231*c*, etc., respectively, in row 229. The remaining alternate zipper strips 167 also adhere to the remaining alternate bundling tapes 160*b*, 160*d*, etc. to form the laminated tape rolls 232*b*, 232*d*, etc., respectively, in row 230. For example, FIG. 9A shows that the adhesive coated top surface 167*a* of a zipper strip 167 will press against the center band bottom surface 161*b* of bundling tape strip 160*a* as the two tapes pass together around winding drum 228 and then onto tape roll 231*a*. Similarly, in FIG. 9B, the adhesive coated top surface 167*a* of the next adjacent zipper strip 167 will press against the center band bottom surface 161*b* of bundling tape strip 160*b* as the two strips pass together around winding drum 228 and then onto tape roll 232*b*.

Figure 12:
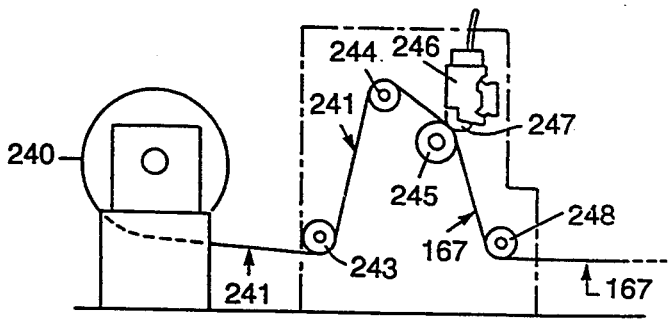

The individual zipper tape strips 167 are obtained from a zipper tape input station D by way of the aforementioned 90° redirect frame 235. In FIGS. 11 and 12, a single full roll 240 (up to 50" in diameter) of brown kraft zipper paper in the form of a wide solid web 241 is mounted on a free wheeling shaft 242 so as to be unwound at a right angle to the flow of the bundling tape web 212 from station A. This zipper paper has a basis weight of about 16.7 lbs. per 1,000 square feet. After passing around idler rollers 243 and 244, this zipper solid web 241 passes over anvil idler 245 at a slitter station E. This station further includes a plurality of knife holders 246 spaced in a row across the width of web 241 as shown in FIG. 11. These holders 246 carry rotatable crush cut cutting wheels 247 (or their equivalent) for slitting web 241 into as many parallel zipper strips 167 as there are rolls 231 and 232 to be produced of the laminated bundling tape 159, e.g., nineteen rolls. Idler roller 248 now directs these multiple zipper strips 167, which are close together after leaving slitter station E, to the 90° redirect frame 235 where each zipper tape 167 is slipped upside down, turned 90° in the plane of FIG. 11, and is spread further apart from the adjacent zipper strips 167 in the manner shown in FIG. 11. Redirect frame 235 generally consists of a series of spaced and parallel round bars 249, one for each zipper strip 167, which are diagonally secured in frame member 235 at about a 45 degree angle with respect to the incoming zipper tape strips 167. Each incoming zipper tape strip 167 passes over and then under a different turning bar 249 so as to emerge from the redirect frame 235 in a direction which allows it to become aligned with a different pair of guide wheels 236 and 237.

EXPERIMENTAL

Non-limiting examples of construction of wallboard bundles using perforated tape with adhered zip tape follow. Wallboard bundles, as described previously, were constructed using a perforated tape with adhered zip tape. Materials used in practicing the present invention can be obtained from the same sources used to produce prior art wallboard bundles. In addition to the preferred resin and water activatable adhesives mentioned earlier, water activated adhesive can be obtained from the Rexford Paper Company of Milwaukee, Wisconsin and Holland Manufacturing Company of Succasunna, New Jersey. Preferred sources of paper for producing perforated tape (e.g., bleached white kraft paper), include Gilman Paper Company of St. Marys, Ga., and International Paper Company of Mobile, Ala. Preferred sources of paper for producing zip tape include Weyerhaeuser Paper company of Tacoma, Wash. and Gaylord Container of Pine Bluff, Ark. Although wallboard comes in standard thicknesses of $\frac{5}{8}$", $\frac{1}{2}$, and $\frac{3}{8}$, other thicknesses may be utilized. All sheets of wallboard used in these experiments had a width of 4 ft. and lengths of 8 or 12 ft. (note that in forming a bundle, both sheets of wallboard have the same dimensions). However, wallboard bundles of varying widths and lengths can also be formed using the present invention. A perforated tape was formed using bleached kraft paper. The perforated tape had a width of 2½. Other widths of perforated tape are contemplated, provided that the width of the perforated tape is greater than the combined thicknesses of the wallboard sheets forming a bundle, so that sufficient tape is available to adhere to the coarse backing surfaces when the rows of perforations are aligned in parallel to the aligned edges of the sheets in the bundle. In a non-limiting embodiment, two parallel rows of perforations, separated by 11/16" are centered on the 2½" width of the bleached kraft paper. By way of non-limiting example, a perforation wheel can be utilized to form the perforations, such as a wheel having 17 teeth per inch, with it being understood that a wide variety of perforation methods and patterns can be utilized. A water-activatable adhesive was coated across the entire width of one surface of the perforated tape to form an adhering surface. Zipper tapes, of ⅝" width and of varying basis weights were then adhered to the center band of perforated tape formed as described previously.

EXAMPLE I

Sets of gypsum boards, 4 ft. in width, ½" in thickness, and 12 ft. in length were formed into bundles utilizing the perforated tape described above laminated to a natural kraft paper zipper tape having a basis weight of about 13.3 lbs. per 1,000 sq. ft. The zipper tape was ⅝" wide and was adhered to the center of the perforated tape center band, which had perforations spaced 11/16" apart. Wallboard bundles were then formed by adhering the outer bands of the adhering surface of the perforated tape to the coarse backing surfaces of opposed sheets of gypsum board. Stacks of 20 bundles formed in this matter were generated.

EXAMPLE II

Bundles of gypsum wallboard were formed as in Example I, with the exception that the zipper tape was formed of natural kraft paper having a basis weight of about 16.7 lbs. per 1,000 sq. ft.

EXAMPLE III

Gypsum wallboard bundles were formed as in Example I, with the exception that the zipper tape was formed using 26 lbs. per 1,000 sq. ft. liner board.

TEAR TESTING RESULTS

The center bands were removed from the perforated tape holding the wallboard bundles in examples I to III together by (1) grasping one end of the zipper tape and pulling away from each wallboard bundle, or (2) simultaneously grasping the end of the zipper tape and center band of the perforated tape and pulling away from each wallboard bundle.

With regard to bundles formed in Example I and in Example II, it was difficult to obtain an acceptably clean tear, particularly when one attempted to remove the center band from a plurality of bundles simultaneously. It was possible to obtain a clean tear when care was used to ensure that the center band was pulled perpendicularly outward from each bundle when removing the center band from bundles formed in Examples I and II. However, under conditions which simulated how the wallboard bundles would be broken apart in actual use (e.g., pulling the tear strip away from a bundle at a substantial angle from perpendicular), a clean tear was noted only when removing the center band from a plurality of bundles formed in Example III. Of about 300 bundles formed and broken apart in Example III, more than 285 bundles exhibited a clean tear when the center bands where removed, either individually or by tearing of a plurality of center bands from a plurality of bundles simultaneously. It was noted that, as the basis weight of the zipper tape increased, the greater the number of bundles which exhibited a clean tear in actual use. In instances where, after removal of the center band, a portion or portions of the broken perforated tape extended over the edge of a board from an opened wallboard bundle, this overlap or overhang of tape was uniform, and therefore did not pose the disadvantage of a jagged edged tape overhang, such as that caused when using a non-perforated tape with a zip tape.

Although the preferred embodiments of the inventions have been described and illustrated herein, it will be understood that various alterations, modifications, and substitutions may be apparent to one of skill in the art without departing from the central spirit of the invention. The scope of the invention is accordingly defined by the following claims:

We claim:

1. A package, comprising:

two sheets of wallboard stacked one on top of the other in alignment, said two sheets including a first piece of wallboard and a second piece of wallboard;

an end edge on each of said first piece of wallboard and said second piece of wallboard;

an elongated strip, said strip having a first edge, a second edge and first and second rows of perforations;

a first band extending from said first edge to said first row of perforations;

a center band extending from said first row of perforations to said second row of perforations and substantially covering said end edges of said first piece of wallboard and said second of piece of wallboard;

a second band extending from said second row of perforations to said second edge;

said bands having co-planar top sides and co-planar bottom sides; adhesive means located on said bottom sides of said first band and said second band;

wherein said bottom side of said first band of said strip is adhered to said first piece of wallboard and said bottom side of said second band of said strip is adhered to said second piece of wallboard to fasten said pieces of wallboard one on top of the other; and wherein said rows of perforations are positioned and dimensioned to facilitate easy removal of said center band of said strip to permit separation of said pieces of wallboard;

a zipper tear strip, said tear strip having dimensions approximately equal to that of said center band and being located between said center band and said end edges, wherein said tear strip further facilitates the easy removal of said center band of said strip so that no portion of said strip and said center band remain on said end edges of said first and second pieces of wallboard.

2. The package of claim 1, wherein said material is wallboard.

3. The package of claim 1, wherein:

said material comprises first and second rectangular sheets of wallboard with each sheet having two side edges, two end edges, a rough surface and a smooth surface;

wherein said sheets are in stacked array defining a bundle in which the smooth surface of said first sheet faces said smooth surface of said second sheet and said end edges of said first sheet are substantially co-planar with said end edges of said second sheet; and wherein said first band is adhered to said rough surface of said first sheet, and said second band is adhered to said rough surface of said second sheet.

4. The package of claim 1, wherein:

said material comprises rectangular sheets of wallboard, each of said sheets having two side edges, two end edges, a rough surface and a smooth surface;

said sheets being arranged in a bundle comprising a first sheet and a second sheet, wherein said smooth surface of said first sheet faces said smooth surface of said second sheet and said end edges of said first sheet are substantially co-planar with the end edges of said second sheet; and wherein said first band is adhered to said end edge of said first sheet and a portion of said rough surface of said first sheet, and said second band is adhered to said end edge of said second sheet and a portion of said rough surface of said second sheet.

5. The package of claim 1, wherein said tear strip is adhered to said center band.

6. The package of claim 3, wherein said tear strip is adhered to said center band.

7. The package of claim 4, wherein said tear strip is adhered to said center band.

* * * * *